United States Patent [19]

Terzian

[11] 3,952,449

[45] Apr. 27, 1976

[54] ARTICULATED FIGURE TOY

[75] Inventor: Rouben T. Terzian, Chicago, Ill.

[73] Assignee: Marvin Glass & Associates, Chicago, Ill.

[22] Filed: Apr. 18, 1975

[21] Appl. No.: 569,167

[52] U.S. Cl. ..... 46/161; 46/123; 46/161

[51] Int. Cl.[2] ..... A63H 3/46

[58] Field of Search ..... 46/116, 119, 123, 127, 46/161

[56] References Cited

UNITED STATES PATENTS

| | | | |
|---|---|---|---|
| 1,911,723 | 5/1933 | Sparlow | 46/123 |
| 2,100,245 | 11/1937 | Fagan | 46/123 |
| 3,163,960 | 1/1965 | Iwaya et al. | 46/123 |
| 3,178,853 | 4/1965 | Greenwood et al. | 46/123 |

*Primary Examiner*—Louis G. Mancene
*Assistant Examiner*—Robert F. Cutting
*Attorney, Agent, or Firm*—Coffee & Sweeney

[57] ABSTRACT

The invention herein described is an articulated figure toy in the shape and form of a four-legged animal, particularly a horse. The neck and head of the figure toy are movable with respect to each other and relative to the body by means of rotary frictional joints. The four legs are pivotally movable by way of three rotary frictional joints per leg. The leg joints are located at the ankle, knee and shoulder or flank areas of the animal permitting simulation of various natural positions. The neck is made of a soft molded plastic providing a capability of side movements with manual urging. Additionally, the head is anchored by a rotary frictional joint to the neck and the neck is anchored at its opposite end by a rotary frictional joint at the body to permit position retentive movement.

22 Claims, 4 Drawing Figures

ARTICULATED FIGURE TOY

SUMMARY OF THE INVENTION

An articulated toy horse having a body or torso with four movable legs having frictional position maintaining joints and an articulated head and neck attached thereto. The head is pivotally movable to the body and the head is pivotally movable with respect to the neck by way of frictional position maintaining joints utilizing the compressibility of the mounting members to form bearing surfaces thereby having the capability of movement in the vertical plane with respect to the body. Additionally, the neck is made from soft plastic material permitting flexible movement with respect to the body. This flexible movement of the neck in conjunction with the vertical joint movement permits a three-dimensional head movement unique among this class of toys. The increased head movements emulate, to a great degree, the head movements of a natural horse. Reins are attached to the head for use with an articulated doll which can be mounted upon the toy horse to simulate the activity of a person riding a horse and turning the horse's head.

DESCRIPTION OF THE PREFERRED EMBODIMENT

Figure 1:
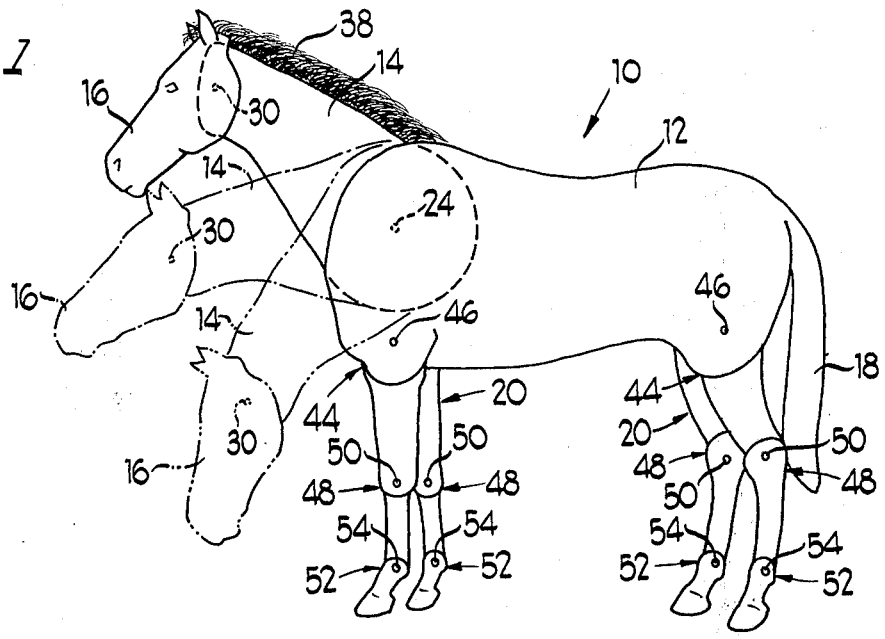
FIG. 1 is a side elevational view of the articulated figure toy of the present invention in a standing position, and showing, in phantom, different vertical positions of the head and neck.

The invention described herein is an articulated figure toy in the form of a four legged animal, particularly a toy horse, generally designated 10. The animal has a generally hollow torso portion 12, a neck portion 14, a head portion 16, a tail portion 18 and four legs, generally designated 20, which depend from the torso portion.

Figure 4:
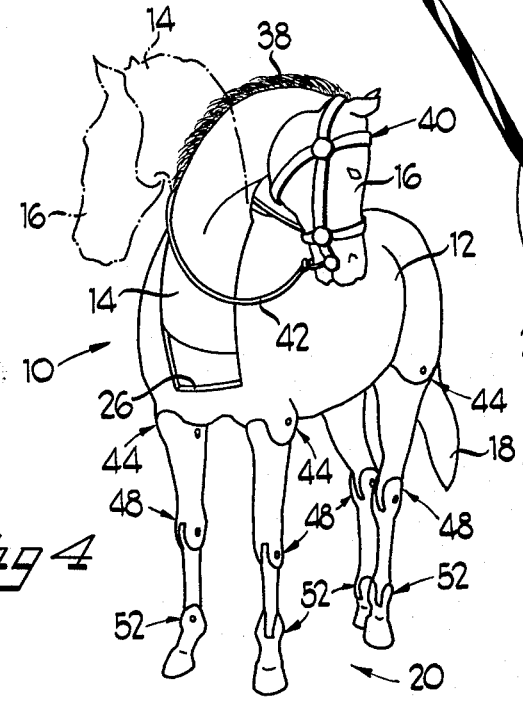
FIG. 4 is a front perspective view of the figure toy of FIG. 1, showing different side movements of the head.

Before going into the details of the invention, generally, the head portion 16 is connected to the neck portion 14 and, in turn, the neck portion 14 is connected to the torso portion 12 by means of frictional rotary joints having position rententive capabilities. In addition, the joints limit the relative movement between the head portion and the neck portion, and the neck portion and the torso portion, to the vertical direction when the animal is in an erect position as shown in FIG. 1. Relative vertical positions are shown in FIG. 1. Further, means are provided at the two rotary frictional joints to limit the relative vertical movement of the portions thereat as shown by the upper and lower positions of the neck portion in FIG. 1. Lastly, the neck portion 14 is fabricated of resiliently flexible material so that, although the joints restrict relative movement thereat to the vertical direction, the animal (particularly a horse) can be manually manipulated so as to bend the neck (particularly in a sideways direction) as shown in FIG. 4 to give increased articulated movement simulating that of an actual four legged animal looking to the rear, particularly the horse shown.

Figure 2:
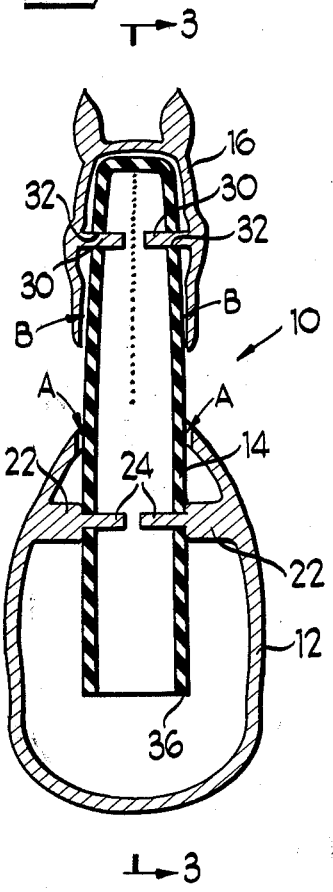
FIG. 2 is an enlarged vertical sectional view taken generally along line 2—2 of FIG. 1.
Figure 3:
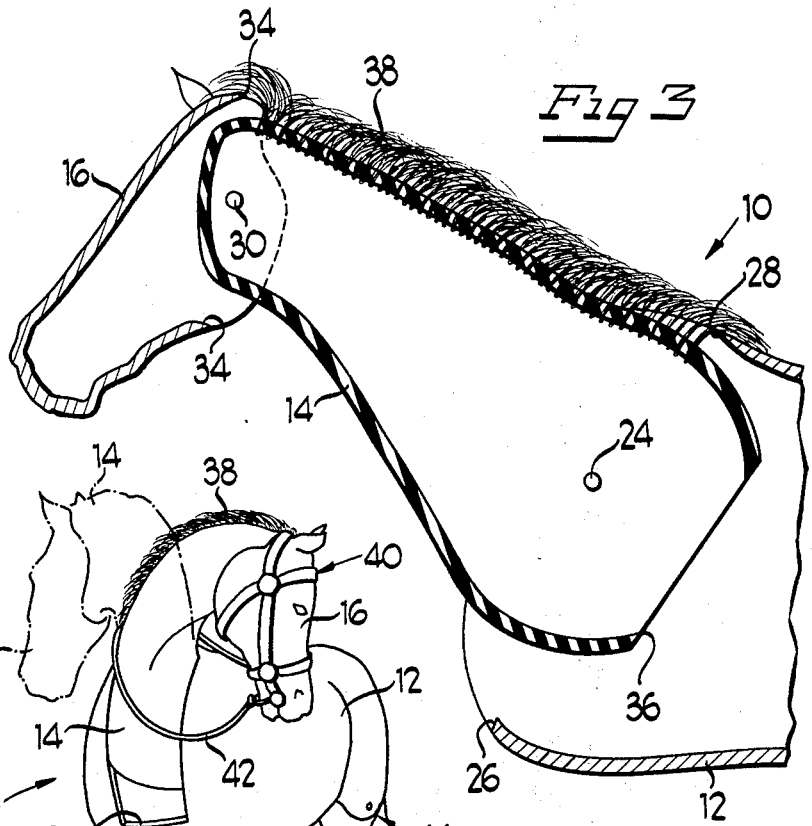
FIG. 3 is a vertical fragmented sectional view taken generally along line 3—3 of FIG. 2.

Turning to the drawings in greater detail, the frictional rotary joint between the neck portion and the torso portion 12 is shown in FIGS. 2 and 3 and comprise a pair of opposed bosses 22 on the interior of the hollow body portion terminating in inwardly directed opposed pins or stub shafts 24 about which the neck portion 14 rotates. Thus, it can be seen that the relative movement at this joint is limited to the vertical direction when the horse is in an erect position. The frictional fit at this joint is provided by the close fit between the resilient neck portion and the pins 24 and interior shoulders of the bosses 22. In addition, the body portion may be formed so as to fit closely to the neck portion in the areas of arrows A (FIG. 2) to add increased frictional resistance for position rententive purposes.

The stop means at the joint between the neck portion 14 and the torso portion 12 is provided by abutment surfaces 26 (FIGS. 3 and 4) and 28 (FIG. 3) against which the neck portion abuts to define the upper and lower extreme positions which are shown in FIG. 1.

The frictional rotary joint between the neck portion 14 and the head portion 16 is somewhat similar to that described above and include a pair of opposed pins 30 (FIGS. 2 and 3) on the interior of the head portion which are received by a frictional fit within aperture 32 in the resiliently flexible material of the neck portion. As described above, additional frictional resistance may be provided by forming the head portion 16 to fit closely against the sides of the neck portion 14 in the areas of arrow B (FIG. 2). Thus, it can be seen that the head portion is provided with articulated movement relative to the neck portion in a vertical direction by rotating about pin 30.

The rotary joint between the head portion and the neck portion also is provided with stop means for limiting the relative vertical movement therebetween. The stop means at this joint comprises a pair of abutment surfaces 34 (FIG. 3) on the head portion which abuts against the top and bottom of the neck portion 14. Note in particular the extended position of the head portion in FIG. 1 in the intermediate position shown therein wherein the abutment surface 34 at the top of the head portion abuts against the top of the neck portion to simulate quite realistically the extended position of a horse's head and neck.

Turning again to the neck portion 14, it can be seen in FIGS. 2 and 3 that the neck portion is generally hollow with an interior cavity surrounded by a layer of resiliently flexible material. An enlarged aperture 36 is formed on the end of the neck portion disposed within the interior of the torso portion to permit access to the interior of the neck portion to facilitate securing simulated hair 38 to the top of the neck portion for the horse's mane.

A bridle, generally designated 40, is embraced about the horse's head portion 16 and has reins 42 leading backwardly therefrom for grasping by a figure toy which may be mounted on the back of the horse to simulate riding and pulling on the reins to cause the horse's head to move in a realistic sideways articulated movement as shown in FIG. 4.

Each of the legs 20 are connected at their upper ends to the torso portion 12 by similar frictional rotary joints, generally designated 44, having pins 46. Similar joints, generally designated 48, having pins 50 are provided in the knee areas of the legs. In addition, similar frictional rotary joints, generally designated 52, having pins 54 are provided in the ankle areas of the legs.

The tail 18 may be formed integral with the body portion 12, as shown, or also may be provided with a rotary or universal joint at the connection with the torso portion.

The foregoing detailed description has been given for clearness of understanding only and no unnecessary limitations should be understood therefrom as some modifications will be obvious to those skilled in the art.

I claim:

1. An articulated figure toy in the form of a four legged animal, comprising:

a torso portion having four legs depending therefrom;

an elongated neck portion;

means defining a rotary joint between one end of said neck portion and the front of said torso portion to provide for relative articulated movement therebetween;

a head portion;

means defining a rotary joint between the other end of said neck portion and said head portion to provide for relative articulated movement therebetween; and said neck portion being fabricated of resiliently flexible material to provide for increased relative articulated movement between said head portion and said torso portion by bending said neck portion.

2. The articulated figure toy of claim 1 including stop means between said torso portion and said neck portion for limiting the relative articulated movement therebetween.

3. The articulated figure toy of claim 1 including stop means between said neck portion and said head portion for limiting the relative articulated movement therebetween.

4. The articulated figure toy of claim 1 wherein the rotary joint between said torso portion and said neck portion includes means defining a friction fit to provide for position retention between the torso portion and neck portion at said rotary joint therebetween.

5. The articulated figure toy of claim 4 including means at said rotary joint between the torso portion and neck portion to limit the relative movement therebetween to a vertical direction when the figure toy is in an erect position.

6. The articulated figure toy of claim 5 including stop limit means at said rotary joint between said torso portion and neck portion to limit the vertical relative movement therebetween.

7. The articulated figure toy of claim 1 wherein the rotary joint between said head portion and said neck portion includes friction means to provide for position retention between the head portion and the neck portion at the rotary joint therebetween.

8. The articulated figure toy of claim 7 including means at said rotary joint between the head portion and neck portion to limit the relative movement therebetween to a vertical direction when the figure toy is in an erect position.

9. The articulated figure toy of claim 8 including stop limit means at said rotary joint between said head portion and neck portion to limit the vertical relative movement therebetween.

10. The articulated figure toy of claim 1 wherein said neck portion is generally hollow defining an interior cavity surrounded by a layer of said resiliently flexible material.

11. An articulated figure toy in the form of a four legged animal, comprising:

a torso portion having four legs depending therefrom;

an elongated neck portion;

means defining a position retaining frictional rotary joint between one end of said neck portion and the front of said torso portion to provide for relative articulated movement therebetween, including means for limiting said relative movement to a vertical direction when the figure toy is in an erect position;

a head portion;

means defining a position retaining frictional rotary joint between the other end of said neck portion and said head portion to provide for relative articulated movement therebetween, including means for limiting said relative movement to the vertical direction when the figure toy is in an erect position; and said neck portion being fabricated of resiliently flexible material to provide for increased relative articulated movement between said head portion and said torso portion by bending said neck portion.

12. The articulated figure toy of claim 1 including stop limit means at both of said frictional rotary joints for limiting the relative vertical movement thereat.

13. The articulated figure toy of claim 11 wherein said neck portion is generally hollow defining an interior cavity surrounded by a layer of said resiliently flexible material.

14. The articulated figure toy of claim 11 wherein each of said four legs have rotary friction joints between the legs and said torso portion, at knee portions of the legs, and at ankle portions of the legs.

15. An articulated figure toy in the form of a four legged animal, comprising:

a torso portion having four legs depending therefrom;

an elongated neck portion having a head on one end thereof;

means defining a rotary joint between the other end of said neck portion and the front of said torso portion to provide for relative articulated movement therebetween; and said neck portion being fabricated of resiliently flexible material to provide for increased relative articulated movement between said head portion and said torso portion by bending said neck portion relative to the torso portion.

16. The articulated figure toy of claim 15 wherein said rotary joint provides for rotation about a transverse axis generally horizontally through the shoulder areas of the animal, with said neck portion being bendable in a sideways motion to simulate the animal looking to its side or rear.

17. The articulated figure toy of claim 15 including stop means between said torso portion and said neck portion for limiting the relative articulated movement therebetween.

18. The articulated figure toy of claim 15 wherein the rotary joint between said torso portion and said neck portion includes means defining a friction fit to provide for position retention between the torso portion and neck portion at said rotary joint therebetween.

19. The articulated figure toy of claim 18 including means at said rotary joint between the torso portion and neck portion to limit the relative movement therebetween to a vertical direction when the figure toy is in an erect position.

20. The articulated figure toy of claim 19 including stop limit means at said rotary joint between said torso portion and neck portion to limit the vertical relative movement therebetween.

21. An articulated figure toy in the form of a four legged animal, comprising:

a torso portion having four legs depending therefrom;

an elongated neck portion having a head portion on one end thereof;

means defining a position retaining frictional rotary joint between the other end of said neck portion and the front of said torso portion to provide for relative articulated movement therebetween, including means for limiting said relative movement to a vertical direction when the figure toy is in an erect position; and said neck portion being fabricated of resiliently flexible material for increased relative articulated movement between said head portion and said torso portion by bending said neck portion relative to the torso portion.

22. The articulated figure toy of claim 21 including stop limit means at said frictional rotary joint for limiting the relative vertical movement thereat.

* * * * *